US010947816B2

(12) United States Patent
McMillon

(10) Patent No.: US 10,947,816 B2
(45) Date of Patent: Mar. 16, 2021

(54) DOWNHOLE GRAPHENE HEAT EXCHANGER

(71) Applicant: Halliburton Energy Services, Inc., Houston, TX (US)

(72) Inventor: Christopher Michael McMillon, Wylie, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 178 days.

(21) Appl. No.: 15/773,843

(22) PCT Filed: Dec. 3, 2015

(86) PCT No.: PCT/US2015/063762
§ 371 (c)(1),
(2) Date: May 4, 2018

(87) PCT Pub. No.: WO2017/095420
PCT Pub. Date: Jun. 8, 2017

(65) Prior Publication Data

US 2019/0063188 A1 Feb. 28, 2019

(51) Int. Cl.
*E21B 36/00* (2006.01)
*E21B 47/017* (2012.01)

(52) U.S. Cl.
CPC ..... *E21B 36/001* (2013.01); *E21B 47/017* (2020.05)

(58) Field of Classification Search
CPC ..... E21B 36/001; E21B 36/00; E21B 47/011; E21B 47/017; E21B 47/013; E21B 47/0175
See application file for complete search history.

(56) References Cited

U.S. PATENT DOCUMENTS

| | | | | |
|---|---|---|---|---|
| 5,547,028 | A | 8/1996 | Owens et al. | |
| 5,931,000 | A | 8/1999 | Turner et al. | |
| 9,297,591 | B1 * | 3/2016 | von Hack-Prestinary | F28F 13/00 |
| 2006/0117759 | A1 | 6/2006 | Hall et al. | |
| 2006/0213660 | A1 | 9/2006 | Difoggio et al. | |
| 2012/0111010 | A1 * | 5/2012 | Geldon | F03G 7/00 60/721 |
| 2014/0144541 | A1 * | 5/2014 | Moreira De Carvalho | B82Y 30/00 138/177 |
| 2014/0146477 | A1 | 5/2014 | Youn | |

OTHER PUBLICATIONS

PCT International Search Report and Written Opinion dated Aug. 16, 2016 issued in corresponding application No. PCT/US2015/063762 filed on Dec. 3, 2015, 14 pgs.

* cited by examiner

*Primary Examiner* — Catherine Loikith
(74) *Attorney, Agent, or Firm* — Chamberlain Hrdlicka

(57) ABSTRACT

A graphene heat exchanger for absorbing thermal energy and located in a downhole tool. The downhole tool is located in a borehole intersecting an earth formation and comprising a thermal component. The heat exchanger includes graphene and is thermally coupled to the thermal component. The heat exchanger is configured to absorb thermal energy from the thermal component or absorb ambient thermal energy from the earth formation.

19 Claims, 3 Drawing Sheets

DOWNHOLE GRAPHENE HEAT EXCHANGER

BACKGROUND

This section is intended to provide background information to facilitate a better understanding of the various aspects of the described embodiments. Accordingly, it should be understood that these statements are to be read in this light and not as admissions of prior art.

To drill a well, a drill bit bores thousands of feet into the crust of the earth. The drill bit extends downward from a drilling platform on a string of pipe, commonly referred to as a "drill string." The drill string may be jointed pipe or coiled tubing. At the lower, or distal, end of the drill string is a bottom hole assembly (BHA), which includes, among other components, the drill bit.

In order to obtain measurements and information from the downhole environment while drilling, the BHA includes electronic instrumentation. Various tools on the drill string, such as logging-while-drilling (LWD) tools and measurement-while-drilling (MWD) tools incorporate the instrumentation. Such tools on the drill string contain various electronic components incorporated as part of the BHA. These electronic components generally include computer chips, circuit boards, processors, data storage, power converters, and the like.

Downhole tools must be able to operate near the surface of the earth as well as many thousands of feet below the surface. Environmental temperatures tend to increase with depth during the drilling of the well. As the depth increases, the tools are subjected to a severe operating environment. For instance, downhole temperatures are generally high and may even exceed 200° C. In addition, pressures may exceed 20,000 psi. In addition to the high temperature and pressure, there is also vibration and shock stress associated with operating in the downhole environment, particularly during drilling operations.

The electronic components in the downhole tools also internally generate heat. For example, a typical wireline tool may dissipate over 100 watts of power, and a typical downhole tool on a drill string may dissipate over 10 watts of power. Although there is electrical power dissipated by a drill string tool, the heat from the drilling environment itself still makes internal heat dissipation a problem. The internally dissipated heat must be removed from the electronic components or thermal failure will occur.

While performing drilling operations, the tools on the drill string typically remain in the downhole environment for periods of several weeks. In other downhole applications, drill string electronics may remain in the downhole for as short as several hours to as long as one year. For example, to obtain downhole measurements, tools are lowered into the well on a wireline or a cable. These tools are commonly referred to as "wireline tools." However, unlike in drilling applications, wireline tools generally remain in the downhole environment for less than twenty-four hours.

When downhole temperatures exceed the temperature of the electronic components, the heat may not be able to naturally dissipate into the environment. The heat will accumulate internally within the electronic components unless there are provisions to remove the heat. Thus, two general heat sources must be accounted for in downhole tools, the surrounding downhole environment and the heat dissipated by the tool components, e.g., electronics components.

While the temperatures of the downhole environment may exceed 200° C., the electronic components are typically rated to operate at no more than 125° C. Thus, due to the extended time downhole, heat transfer from the downhole environment and the heat dissipated by the components will result in thermal failure of those components. Generally, thermally induced failure has two modes. First, the thermal stress on the components degrades their useful lifetime. Second, at some temperature, the electronics fail and the components stop operating.

Thermal failure can be very expensive. The expense is not only due to the replacement costs of the failed electronic components, but also because electronic component failure interrupts downhole activities. Trips into the borehole also use costly rig time. An effective apparatus and method to cool electronic components in downhole tools would greatly reduce costs incurred during downhole operations associated with thermal failure.

Another problem with downhole tools is that power generation downhole uses passive power storage devices, such as pressure vessels or electric batteries. There is a need for a power source that can actively generate power downhole.

BRIEF DESCRIPTION OF THE DRAWINGS

For a detailed description of the embodiments of the invention, reference will now be made to the accompanying drawings in which.

DETAILED DESCRIPTION

This disclosure generally relates to absorbing thermal energy using a heat exchanger comprising graphene to absorb thermal energy downhole in a downhole tool.

Graphene can absorb thermal energy logarithmically according to the size of the sample. As used in herein, graphene refers to a carbon material comprising a single layer of carbon atoms that are bonded together in a hexagonal honeycomb lattice. Graphene can be used in a heat exchanger to absorb thermal energy radiating from a thermal component in a downhole tool. Alternatively, the graphene can be used in a heat exchanger used to insulate thermal components from the ambient thermal temperature of the earth formation downhole. The graphene heat exchanger can also be used to buffer heat spikes within the downhole tool system, e.g., heat spikes generated from cycling power on electromagnetic equipment such as transmitter antennas. Also, a heat exchanger using graphene can lengthen the time that a temperature differential exists in a Stirling engine located in the downhole tool, thus increasing the effective operation time of the Stirling engine. The term "Stirling engine" is intended to mean an engine having a closed-system that alternately heats and cools a working fluid in a closed housing.

Figure 1:
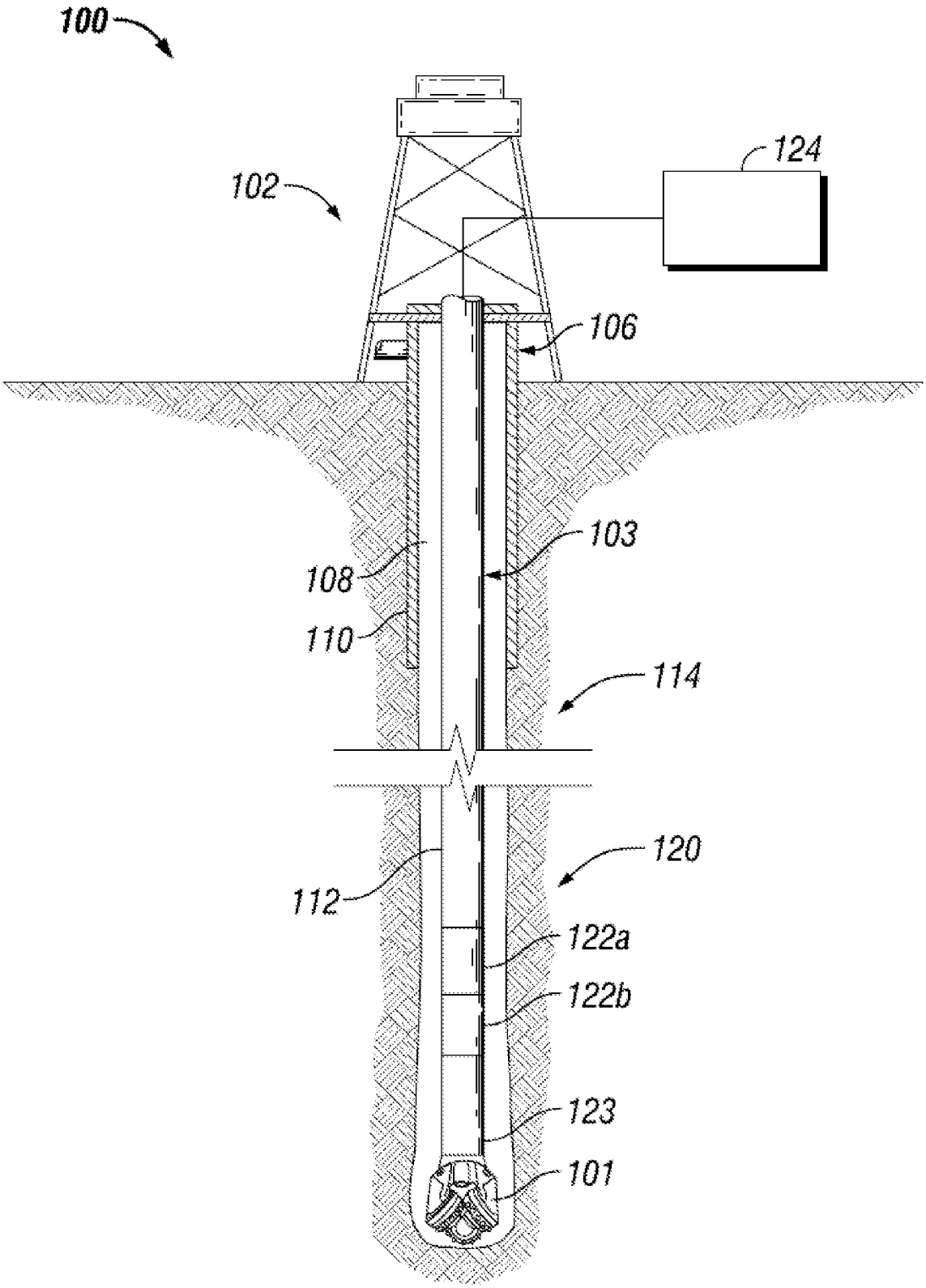
FIG. 1 depicts a schematic view of an example drilling operation, according to one or more embodiments.

FIG. 1 depicts a schematic view of a drilling operation 100, in accordance with example embodiments of the present disclosure. Various types of drilling equipment such as a rotary table, drilling fluid pumps and drilling fluid tanks (not expressly shown) may be located at a well site 106. For example, the well site 106 may include a drilling rig 102 that has various characteristics and features associated with a "land drilling rig." However, downhole drilling tools incorporating teachings of the present disclosure may be satisfactorily used with drilling equipment located on offshore platforms, drill ships, semi-submersibles and drilling barges.

The well 114 formed by the drilling system 100 may be a vertical well, such as that illustrated in FIG. 1. In some other embodiments, the well 114 may be a horizontal well or a directional well having a range of angles. Thus, the well system 100 can be a vertical drilling system or a directional drilling system. The well 114 may be defined at least in part by a casing string 110 that may extend from the surface of the well site 106 to a selected downhole location. Portions of the well 114 that do not include the casing string 110 may be described as "open hole."

The drilling system 100 may include a drill string 103 suspended downhole from the well site 106 and defining annulus 108. The drill string 103 includes a drill pipe 112, a bottom hole assembly (BHA) 120, and a drill bit 101. The drill pipe 112 may include a plurality of segments, each of which are added to the drill pipe 112 as the well 114 is drilled and increasing length of drill pipe 112 is required. The drill pipe 112 provides the length required for the BHA 120 to reach well bottom and drill further into the formation. The drill pipe 112 may also deliver drilling fluid from surface facilities at the well site 106 to the BHA 120.

The BHA 120 may include a wide variety of components configured to assist in forming of the wellbore 114. For example, the BHA 120 may include components (downhole tools) 122*a* and 122*b*. Such components 122*a* and 122*b* may include, but are not limited to, drill collars, rotary steering tools, directional drilling tools, downhole drilling motors, reamers, hole enlargers or stabilizers, and the like. The number and types of components 122 included in the BHA 120 may depend on anticipated downhole drilling conditions and the type of wellbore that is to be formed. The BHA 120 also includes logging while drilling (LWD) tools and/or measurement while drilling (MWD) tools 123. The LWD/MWD (downhole) tools 123 are configured to collect data regarding the wellbore during drilling.

Aspects of the drilling operation, including the LWD/MWD tool 123 and other parts of the BHA 120 may be controlled by an above-ground control system 124. The control system 124 transmits instructions to the BHA 120 and receives feedback or data from the BHA 120 such as data collected by the LWD/MWD tool 123.

In some example applications, the LWD/MWD tool 123 are configured to perform borehole imaging, which is commonly used to inspect the wellbore 114 wall conditions to detect formation fractures, geological beddings and borehole shapes. Borehole imaging may also be performed to inspect the casing for deformation, corrosion and physical wear. Two common types of borehole imaging include ultrasonic imaging and micro-resistivity imaging. In ultrasonic imaging, ultrasonic waves are aimed to the wellbore 114 wall, and the travel time and amplitude of the reflected waves are recorded to form an imaging of the wellbore 114. Micro-resistivity imaging sends the electric-magnetic waves into the wellbore 114 wall to generate resistivity images of the wellbore 114.

In order to generate clear wellbore 114 images, it is helpful to keep the LWD/MWD tool 123 centered and stable within the wellbore 114. However, this is difficult to accomplish due to movement and shaking of the BHA 120 during drilling. The impact of the drill bit 101 against the bottom of the wellbore 114 during drilling may cause more erratic motions of the LWD/MWD tool 123. Thus, the LWD/MWD tool 123 of the present disclosure is instrumented with one or more accelerometers and magnetometer from which movement and position data can be derived and used to filter the wellbore image, thereby reducing the blurring effects of the movement of the LWD/MWD tool 123.

Logging while drilling and measurement while drilling operations are example operations facilitated by the techniques provided herein. However, the systems and methods provided herein can also be applied to wireline logging operations and tools, and logging operations and logging tools in general.

FIGS. 2A, 2B, 2C, 2D, and 2E depict schematic views of an example heat exchanger 201 thermally coupled to a thermal component 203, according to one or more embodiments. The heat exchanger 201 and thermal component 203 are located in a downhole tool (e.g., 122*a*, 122*b*, 123). The heat exchanger 201 includes graphene and is thermally coupled to one or more thermal components 203.

In embodiments, the thermal component 203 includes, but is not limited to, heat-dissipating components, heat-transferring components, heat-generating components, heat-storing components, and/or heat-sensitive components. As examples, the thermal component can be an electric component, a power source, vacuum flask, thermal storage container, thermal housing, a Stirling engine, or any other suitable electrical or mechanical component that can generate, transfer, or store heat. The power source includes a battery, pressure vessel, a mud motor, or any suitable device that generates or stores power. The electric component includes an integrated circuit, antenna coil, inductor, transformer, capacitor, resistor, or any electric component that produces thermal energy. The heat exchanger 201 can be configured to absorb (a) the thermal energy radiating from the thermal component 203, (b) the ambient thermal energy radiating from the earth formation (i.e., insulating thermal components from the ambient temperature downhole), or (c) thermal energy spikes from the downhole tool system.

The heat exchanger 201 can be indirectly thermally coupled to the thermal component 203. For example, an adhesive can be used to couple the thermal exchanger 201 to the thermal component 203. The heat exchanger 201 may also be coupled indirectly with other elements or components between the heat exchanger 201 and the thermal component 203 such that thermal energy is transferred from the thermal component 203 to the heat exchanger 201 through the intermediary components.

Figure 2A:
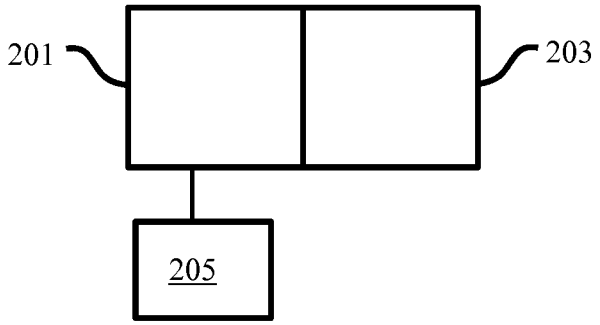
FIG. 2A depicts a schematic view of an example heat exchanger thermally coupled to a thermal component, according to one or more embodiments.
Figure 2B:
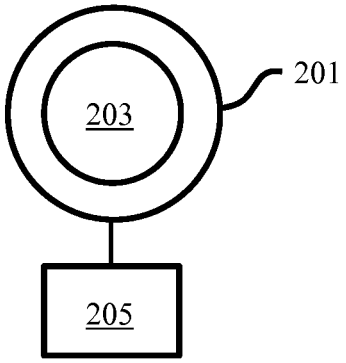
FIG. 2B depicts a schematic view of an example heat exchanger thermally coupled to a thermal component, according to one or more embodiments.

The heat exchanger 201 may be configured in different ways. For example, the heat exchanger 201 can have multiple layers of graphene (such as folded (FIG. 2C) or laminated layers) coupled to the thermal component 203 to increase the unit length of the heat exchanger 201. Referring to FIG. 2B, the heat exchanger 201 can have one or more graphene layers around some or all of the thermal component 203, such as one or more layers of graphene spirals (FIG. 2D), rings, helixes (FIG. 2E), shells, or coatings. Thus, the heat exchanger 201 includes graphene layers, yielding a logarithmic increase in thermal absorption.

The heat exchanger 201 can also be thermally coupled to a thermal management system 205 to prolong the amount of time the heat exchanger 201 remains at a temperature below the ambient temperature of the earth formation or an operational temperature of the thermal component 203. In embodiments, the operational temperature of the thermal component 203 is a maximum temperature at which the thermal component can operate before failure or a reduction in operational life time. The heat exchanger 201 can transfer some of its absorbed thermal energy to the thermal management system 205. As such, the thermal management system 205 discretely manages the temperature of the heat exchanger 201. The thermal management system 205 may include a heat storage unit suitable for absorbing thermal energy from the heat exchanger 201. Optionally, the heat exchanger 201 includes radiating fins to transfer the absorbed thermal energy to a fluid thermally coupled to the heat exchanger 201. Additionally, the heat exchanger 201 can be cooled by being pulled back up the borehole to the surface or a depth within the borehole that has a sufficient ambient temperature to cool the heat exchanger 201.

Figure 3:
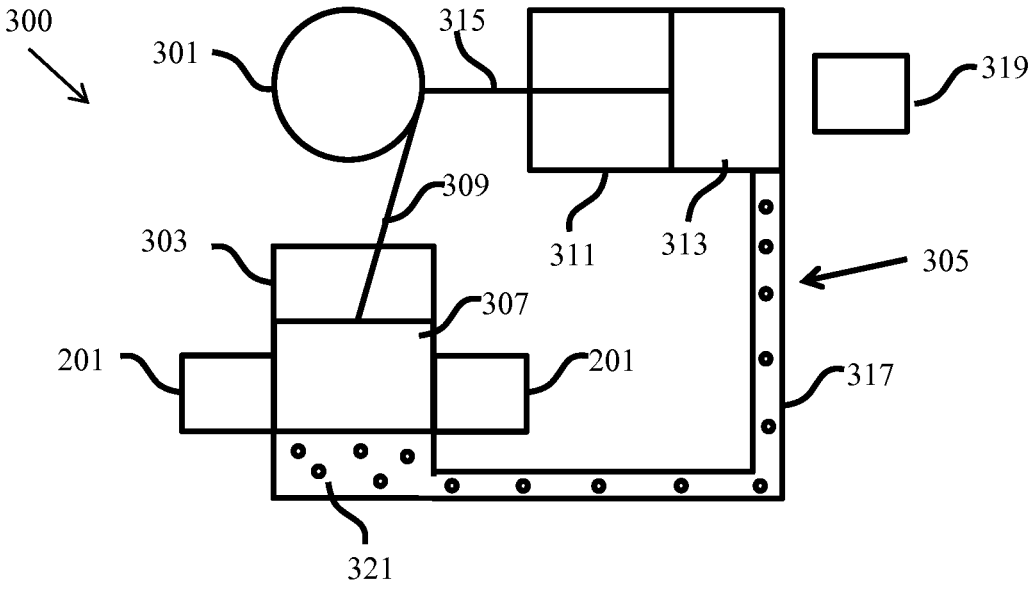
FIG. 3 depicts a schematic view of an example heat exchanger thermally coupled to a Stirling engine, according to one or more embodiments.
Figure 2C:
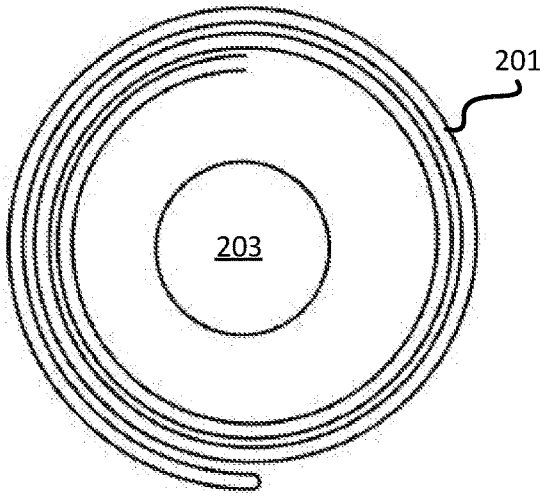
FIG. 2C depicts a schematic view of an example heat exchanger thermally coupled to a thermal component, according to one or more embodiments.
Figure 2D:
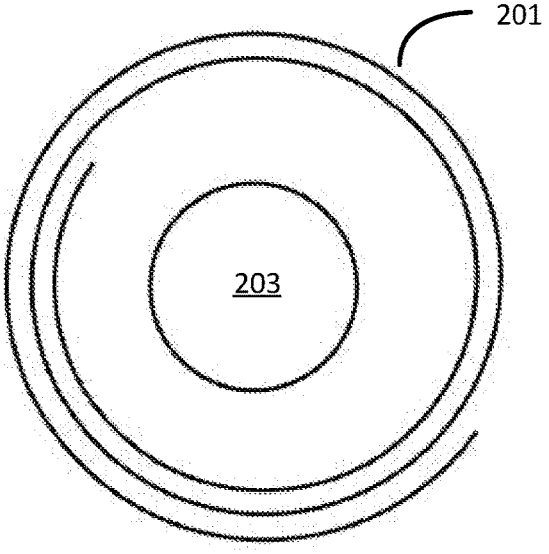
FIG. 2D depicts a schematic view of an example heat exchanger thermally coupled to a thermal component, according to one or more embodiments.
Figure 2E:
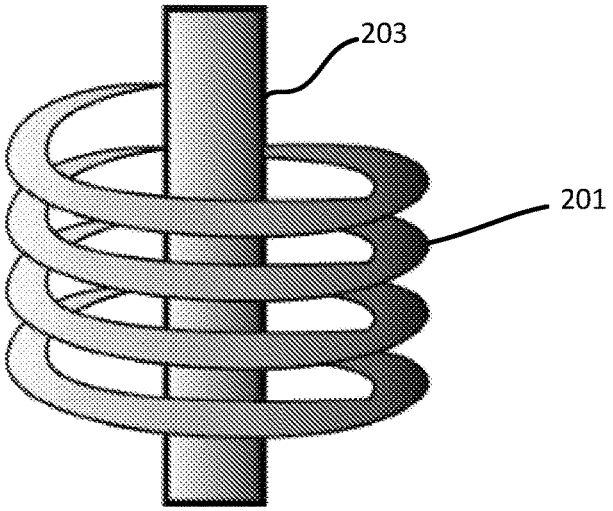
FIG. 2E depicts a schematic view of an example heat exchanger thermally coupled to a thermal component, according to one or more embodiments.

FIG. 3 depicts a schematic view of an example heat exchanger 201 thermally coupled to a Stirling engine 300, according to one or more embodiments. The Stirling engine 300 is located in a downhole tool (122*a*, 122*b*, 123) to actively generate mechanical or electrical power. The Stirling engine 300 depicted in FIG. 3 is intended as an example and other configurations for the Stirling engine 300 may be employed to actively generate power downhole. For example, the Stirling engine 300 can be any suitable engine that generates power from a temperature differential of a working fluid within a closed housing.

The Stirling engine 300 includes a closed housing 305 including a first (cooling) cylinder 303, a second (heating) cylinder 311, and a fluid channel 317. These cylinders 303, 311 are in fluid communication with each other through the fluid channel 317. A first piston 307 is inside the first cylinder 303 and coupled to a crank 301 via a first connector rod 309. A second piston 313 is inside the second cylinder 311 and coupled to the crank 301 via a second connector rod 315. A heat source 319 is thermally coupled to the heating cylinder 311 to heat a working fluid 321 within the housing 305. As an example, the heat source 319 can transfer ambient thermal energy radiating from the earth formation to the heating cylinder 311.

The heat exchanger 201 is thermally coupled to the cooling cylinder 303 according to any of the techniques described herein. The heat exchanger 201 is thermally coupled to the first cylinder 303 to absorb thermal energy from the working fluid 321 maintaining a temperature differential between the working fluid 321 within the first cylinder 303 and the working fluid 321 within the second cylinder 311. This temperature differential creates a pressure differential between the cylinders to cyclically turn the crank 301 according to the cyclical motion of the pistons 307, 313. The crank 301 can be coupled to an electric generator or a mechanical device (not shown) to actively generate power downhole.

As the first piston 307 presses the working fluid 321 into the heating cylinder 311, the working fluid 321 is heated by the heat source 319, expanding the working fluid 321. The expanded working fluid 321 transfers from the heating cylinder 311 to the cooling cylinder 303. The crank 301 can be weighted such that the momentum of the crank 301 moves the second piston 313 to transfer any more working fluid to the cooling cylinder 303. Upon entering the cooling cylinder 303, the heat exchanger 201 absorbs some of the thermal energy within the working fluid 321, contracting the working fluid and drawing the pistons 307, 313 away from the crank 301. Further, the crank 301 can be weighted such that the momentum of the crank 301 moves the first piston 307 to transfer any more working fluid to the heating cylinder 311, completing the cycle of the Stirling engine 300.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. The term "thermally couple" or "thermally couples" is intended to mean either an indirect or direct thermal connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A downhole apparatus for performing a task in a borehole intersecting an earth formation and having downhole temperature due to ambient thermal energy of the formation, comprising:

a thermal component having an operating temperature condition below that of the downhole temperature in the borehole and operable to generate thermal energy; and a heat exchanger comprising graphene layers, wherein the heat exchanger is thermally coupled to the thermal component and configured to absorb the thermal energy generated from the thermal component such that the thermal component temperature condition is maintained below the downhole temperature, wherein each layer yields a logarithmic increase in thermal absorption according to a size of each layer.

2. The downhole apparatus of claim 1, wherein the heat exchanger is indirectly thermally coupled to the thermal component.

3. The downhole apparatus of claim 1, wherein the heat exchanger is configured to absorb the ambient thermal energy from the earth formation.

4. The downhole apparatus of claim 1, wherein the thermal component comprises a power source, and the heat exchanger is configured to absorb thermal energy generated by the power source.

5. The downhole apparatus of claim 1, wherein the thermal component comprises an electronic component, and the heat exchanger is configured to absorb thermal energy generated by the electronic component.

6. The downhole apparatus of claim 1, wherein the thermal component comprises a Stirling engine comprising a temperature condition of a temperature differential and the heat exchanger is configured to maintain the temperature differential needed for the Stirling engine to operate in the borehole.

7. The downhole apparatus of claim 1, wherein the graphene layers of the heat exchanger are arranged around the thermal component.

8. The downhole apparatus of claim 1, wherein the graphene layers of the heat exchanger are arranged in a spiral around the thermal component.

9. The downhole apparatus of claim 1, wherein the graphene layers of the heat exchanger are folded on the thermal component.

10. The downhole apparatus of claim 1, wherein the heat exchanger is configured to absorb thermal energy spikes.

11. A method of absorbing thermal energy in a borehole intersecting an earth formation and having downhole temperature due to ambient thermal energy of the formation, comprising:

running a downhole tool comprising a thermal component having an operating temperature condition below that of the downhole temperature in the borehole;

generating thermal energy with the thermal component; and absorbing at least some of the thermal energy from the thermal component using a heat exchanger comprising graphene layers such that the thermal component temperature condition is maintained below the downhole temperature, wherein each layer yields a logarithmic increase in thermal absorption according to a size of each layer.

12. The method of claim 11, further comprising absorbing the ambient thermal energy from the earth formation using the heat exchanger.

13. The method of claim 11, wherein the thermal component comprises a power source.

14. The method of claim 11, wherein the thermal component comprises an electronic component.

15. The method of claim 11, wherein the thermal component comprises a Stirling engine comprising a temperature condition of a temperature differential and wherein the heat exchanger maintains the temperature differential needed for the Stirling engine to operate in the borehole.

16. The method of claim 11, wherein the graphene layers of the heat exchanger are arranged around the thermal component.

17. The method of claim 11, wherein the graphene layers of the heat exchanger are arranged in a spiral around the thermal component.

18. The method of claim 11, wherein the graphene layers of the heat exchanger are folded on the thermal component.

19. The method of claim 11, wherein absorbing thermal energy using the heat exchanger comprises absorbing thermal energy spikes.

* * * * *